US006322012B1

(12) United States Patent
Päper

(10) Patent No.: US 6,322,012 B1
(45) Date of Patent: Nov. 27, 2001

(54) CUTTING SHAFT WITH CUTTING TOOLS FOR A SHREDDING/CRUSHING MACHINE

(76) Inventor: Bernd Päper, Dornechstrasse 19, Hofstetten (CH), 4114

( * ) Notice: Subject to any disclaimer, the term of this patent is extended or adjusted under 35 U.S.C. 154(b) by 0 days.

(21) Appl. No.: 09/310,536

(22) Filed: May 12, 1999

(30) Foreign Application Priority Data

May 12, 1998 (DE) ..... 198 21 206
May 12, 1998 (DE) ..... 198 21 204

(51) Int. Cl.[7] ..... B02C 15/16
(52) U.S. Cl. ..... 241/243; 241/294
(58) Field of Search ..... 241/294, 243, 241/73

(56) References Cited

U.S. PATENT DOCUMENTS 5,873,534 * 2/1999 Shinn ..... 241/294

* cited by examiner

*Primary Examiner*—Mark Rosenbaum
(74) *Attorney, Agent, or Firm*—Townsend and Townsend and Crew LLP

(57) ABSTRACT

The invention concerns a cutting shaft for a cutting machine having knife seat grooves distributed so as to be spirally wound on the periphery in the cutting shaft, whereby cutting tools are arranged in the knife seat groove which protrude with a cutting edge beyond the periphery of the cutting shaft and mesh with corresponding counter cutting means of the cutting machine, whereby, to change the cutting contour, cutting tools having at least the same cutting edge length and the same maximum protrusion beyond the cutting shaft, but slighter engagement depth, are arranged with counter cutting means in the shaft. The invention also concerns a cutting tool for a cutting shaft of a shredding machine, whereby knife seat recesses, wound spirally, are distributed on the periphery in the cutting shaft for the cutting tools and the cutting tools have a pointed cutting contour projection beyond the upper and peripheral surface of the cutting shaft, whereby, to extend the cutting edge, the cutting edges of the cutting tool are staggered, stepped or toothed.

14 Claims, 8 Drawing Sheets

CUTTING SHAFT WITH CUTTING TOOLS FOR A SHREDDING/CRUSHING MACHINE

The invention concerns a cutting shaft with cutting tools for a shredding/crushing machine in which cutting tools seated in knife seat grooves spirally wound and distributed on the periphery of a cutting shaft work in opposition to counter cutting edges mounted independently of the shaft.

BACKGROUND OF THE INVENTION

A shredding/crushing machine, which is the subject of this invention, is shown in FIGS. 23, 24 and disclosed in, DE 42 42 740 A1. The machine is used for cutting and reducing wood, metal parts, plastic material, garbage and other waste materials to small pieces.

The shredder/crusher 101 essentially consists of a material hopper 102, a food unit 103 and a cutting tool 104. The three machine components 102, 103, 104 are connected to one another so as to be detachable by flanged couplings and, when assembled, form a feeding chamber 105. In the feeding chamber 105, a cutting shaft 106 driven by an electromotor engages in this lower area opposite the feed unit 103. The cutting shaft 106 is octagonal or polygonal in shape and is equipped with a number of cutting tools 107. The cutting tools 107 are fastened to the cutting shaft 106 spirally wound and distributed over the periphery (FIG. 23) and are engaged with a first cutting plate 108 and a second cutting plate being used as a scraping bar. The upper side of the first cutting plate 108 is simultaneously part of the floor of the feed chamber 105. A perforated screen 111 fastened to reinforcing rings 110 is fastened below the cutting shaft 106. A collecting tray 112 is situated below the screen 111, a worm conveyor 113 being connected to the lowest point of said collecting tray for removing the shredded/crushed material. FIG. 10 shows the cutting shaft 16 in a perspective of a partial view, as seen from the feeding chamber 105. The cutting shaft 106 has a number of cutting tools 107 which are attached to the cutting shaft 106 in a thread-like manner. The cutting tools 107 sit in the recesses 129 placed into the cutting shaft 106. The recesses 129 extend from a first edge 140 or the cutting shaft 106 to the second edge 141 following in direction of rotation. The base 142 of the recess 129 deepens uniformly relative to a cutting shaft surface 139 over its entire longitudinal extension. The base 142 or the supporting area 131 forms a right angle with the contact surface 131. The height of the contact surface 131 between the second edge 141 and the base 142 corresponds to the diagonal extension of a cutting tool 107.

The knives 104 which are square in cross section are arranged on the shaft 106 so as to be in a diagonally upward position and form a cutting edge 107*a* in the shape of a pointed roof with a cutting point 107*b* protruding upward.

A shredder/crusher of this type has proven successful.

In the field of waste recycling and disposal of waste materials, disposal firms must respond more and more flexibly to the various materials to be processed. Thus, for example, not only hard materials such as plastic housings, plastic products, electronic parts or other breakable materials have to be shredded or crushed, but also stretch materials, woven synthetic materials, carpets, threads and fibers of all types. In addition, the material to be cut often varies considerably in size and volume; for example, small-sized hollow plastic bodies (PET bottles) and plastic barrels must be handled. Experience has shown that unsatisfactory results are often obtained with respect to the cutting work when using preset a driving power for the cutting shaft and a preset size for the cutting tools.

DE-GM 295 15 768.2 discloses cutting tools for shredding machines. The cutting tools consist of several parts, having a cutting tool body and one or two cutting plates. The cutting tool body is an elongated one-piece metal body having, for example, a square cross section, two front surfaces and four similar lateral surfaces. The cutting tool body is somewhat shorter than the cutting tool shown in FIGS. 1 and 2. At the front surfaces, a longitudinally axially tapped hole is placed in the canter into which a screw can engage to fasten a cutting plate. The front surfaces have a contoured surface with two cross-shaped grooves which each extend between the points of the front surfaces.

The cutting plates are thin metal plates which can have a corresponding square shape like the front surfaces of the tool body. A hole, through which a fastening screw can pass, is placed in the centre of the cutting plates. On their back side, the cutting plates have webs arranged transversely which are adapted to the shape of the grooves of the cutting tool bodies so that the cutting plates can be fastened in a form-locking and torque resistant manner to the front surfaces of the cutting tool bodies.

The cutting tool bodies, each having a cutting plate, form a cutting tool which has the same spatial shape and the same dimensions as the one-piece cutting tool of FIGS. 23 and 24. All four points of the cutting tools can be used as a cutting point, so that a cutting tool with two cutting plates can be used eight times.

Cutting tools of this type have proven successful. However, it was found that, with a set cutting tool size of e.g. 40×40×64 mm, it is not possible to efficiently obtain a defined granular, size, in particular of lose than 10 mm. Although an increase in rotational speed and an even larger number of knives on the knife shaft can lead to an increase in cutting speed and a higher cutting sequence and, as a result, a fine granulation, however, this also causes friction and heat, especially in the area of the screen basket area. Moreover, additional suctioning devices are required that draw off the fine material through the screen basket area by suction and prevent unnecessary material rotation about the shaft body and a decrease in throughput. In addition, it was found that, in PVC or stretch foils having a low melting point, the heat formation can be so high that it can result in melting of the material and blockages in the cutting system.

The object of the invention is to create a cutting shaft for a shredding machine which can easily and quickly be optimally adjusted to the material to be cut and, moreover, to provide a cutting tool with which it is also possible to produce defined, in particular, small granular sizes without thereby altering the quality of the material to be cut.

SUMMARY OF THE INVENTION

According to the invention, the cutting shaft is furnished with an easily exchangeable cutting contour. To accomplish this, cutting tools in the form of cutting blocks which are rhombic in cross section are used in enlarged knife seats of cutting shafts which are double the size in comparison to cutting blocks which are rhombic in cross section and customarily used. As a result, the available and inverted V-shaped cutting edge, projecting outward from the cutting shaft, is quadrupled in its length. According to the invention, this solid large cutting block can be replaced by cutting blocks which have the same structure as the large cutting blocks at the knife seat end, however, which are M-shaped on the cutting edge and with a deep V-shaped groove. The two serrations formed hereby and pointing outward are arranged in such a way that they are situated on the same flight circle of the knife, i.e. have the same radial distance from the base of the knife seat in the individual points of large cutting blocks. According to a further advantageous embodiment of the invention, the basic body of the cutting block has two flat recesses, rhombic in a top view, at the front in the area of the two serration, the edge length of which corresponds to the edge length of the serrations. Knife plates can be inserted into the recesses.

In addition, it is also possible to furnish cutting blocks having the usual size in conventional knife seats but with the above described finer cutting geometries, i.e. two cutting points. It is thus possible to cut the material of different sizes with a single cutting shaft adjusted to the material to be cut, whereby the cutting contour can be easily and quickly changed.

To optimally adjust the cutting power of the shaft or the torque of the shaft to the material to be cut, the number of cutting tools an the shaft can be reduced, whereby the empty knife seats are covered with covering elements in a lid-like manner. As a result the cutting operation can be optimally adjusted to the material to be cut.

According to the invention, it was also, found that a fine granulation can be obtained with an elevation of the cutting edge surface or extension of the cutting edge at the same speed, whereby the elevation or extension of the cutting edge surface is obtained with serrated knives. These serrated knives have stopped cutting edges projecting outward in contrast to the conventional cutting tools with straight cutting edges arranged at an angle of 90° to one another. The counter edges of the cutting edges and scraping bars correspond with this cutting contour. The serrated knives can be made similar to the conventional cutting blocks as blocks. To retrofit existing cutting machines, however, it is also possible to bolt the serrated knives as serrated knife plates to the front of the previously used cutting blocks, whereby the cutting blocks Are shortened by the thickness of the plates.

It was surprisingly found that, with an unchanged driving power and speed of the cutting shaft, granules of less than 10 mm were produced when using the serrated knives of the invention at the highest throughput capacity, without this resulting in troublesome heat development. If particular, in a cutting machine furnished with the serrated knives of the invention, problematic hollow plastic bodies such as PET bottles or a precompression can also be granulated. Usually, hollow plastic bodies of this type are first compressed into balls and only granulated subsequently. This intermediate step can now be omitted and the hollow bodies can be directly granulated, The granulated hollow body has an optimum bulk density for transport, so that large capacity transport, e.g. in so-called "big bags" is possible.

BRIEF DESCRIPTION OF THE DRAWINGS

The invention shall be described in the following by way of example and with reference to the drawings, showing.

DESCRIPTION OF THE PREFERRED EMBODIMENTS

Figure 1:
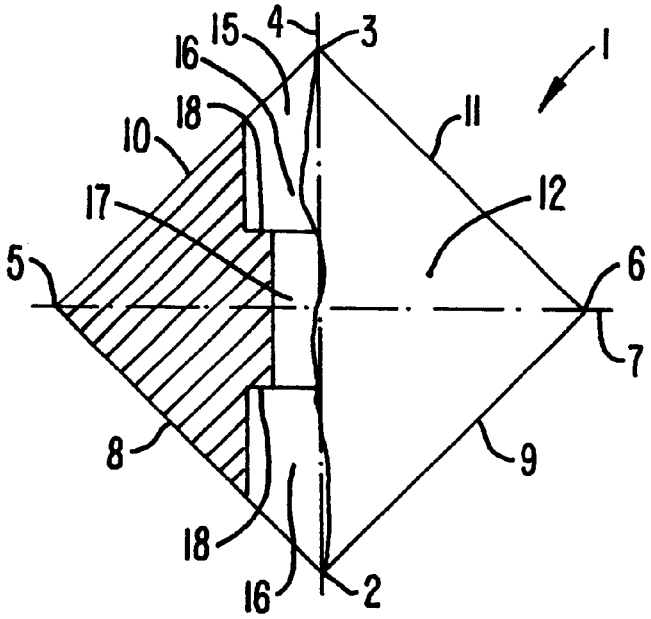
FIG. 1 is an enlarged cutting block according to the invention in a partial sectional top view.
Figure 2:
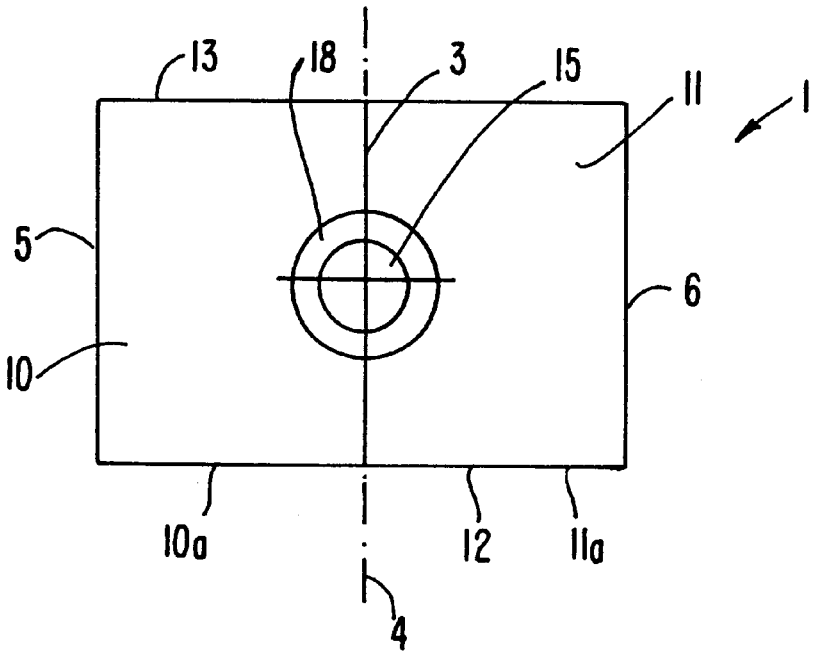
FIG. 2 is a cutting block according to FIG. 1 in a top view.
Figure 5:
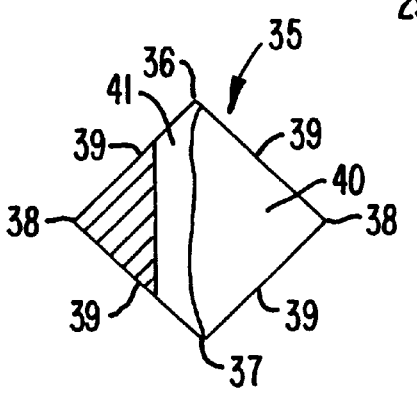
FIG. 5 is an insert for a rotating cutting block according to FIG. 3 in a partially cut top view.
Figure 3:
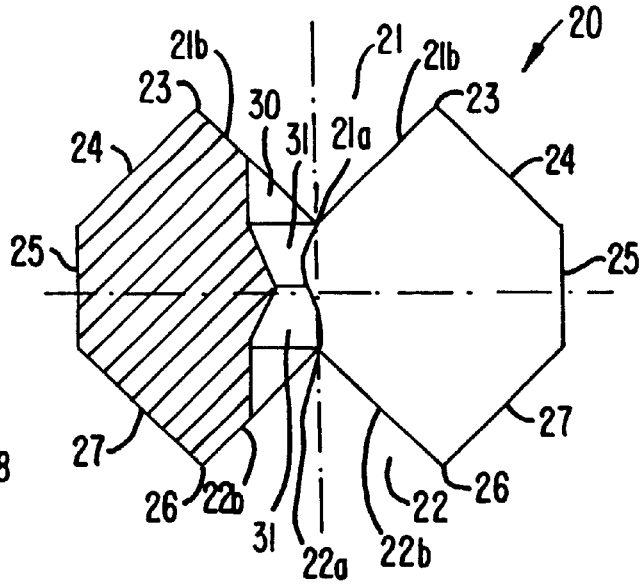
FIG. 3 is rotating cutting block having two cutting points in a partial sectional top view.
Figure 6:
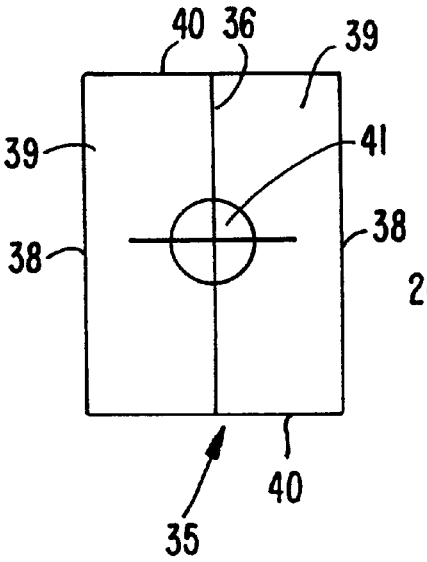
FIG. 6 is an insert according to FIG. 5 in a view from the top.
Figure 4:
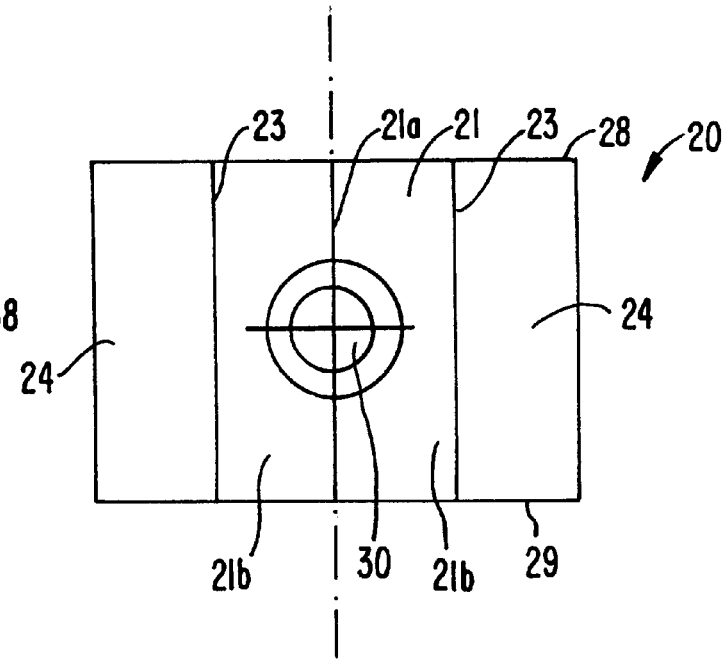
FIG. 4 is a cutting block according to FIG. 3, in a top view.

An enlarged cutting tool (FIGS. 1, 2) according to the invention is a block, rhombic in cross-section, with a lower edge 2 and an upper edge 3 opposite thereto, which, fix a vertical plans 4. In addition, the block 2 has opposite horizontal edges 5, 6 which fix a horizontal plane 7 that is at right angles to the plane 4 and cuts it at the centre. The edges 2, 5 define a lower diagonal surface 8, the edges 2, 6 define a lower diagonal surface 9 of the rhombic cutting block. The edges 5, 3 define an upper diagonal surface 10, the edges 6, 3 define an upper diagonal surface 11. The rhombic block 1 designed in this way with four similar surfaces has, in addition, two rhombic front surfaces 12, 13.

A cutting tool or cutting block 1 lies in a V-shaped groove or a V-shaped knife seat of a cutting shaft with these surfaces 8, 9. With a front end 13, the cutting block 1 adjoins a flat knife backing of the cutting shaft, with surface 22, the cutting block 1 points in direction of rotation, whereby the common edge 11*a* of surface 11 and the front end 12 form a cutting edge in the shape of a pointed roof projecting beyond the periphery of the cutting shaft.

Longitudinally in the centre, a vertical bore or a vertical hole 15 is placed in the cutting block 1 from edge 3 to edge 2 which has, from the edges 2, 3 to the inside of the cutting block, two wide cylindrical hole areas 16 and an axially aligning narrow hole area 17 connecting the wide hole areas 16 to one another, so that a step 18 each if formed between the wide hole areas 16 and the narrow hole area 17. The bore 15 or the hole 15 serves to receive a threaded bolt to fasten the cutting block 1 in the groove of a cutting shaft. The steps 18 serve as a bearing for a screwhead of the threaded bolt.

In a further embodiment of cutting tool (FIGS. 3 to 6), the cutting block 20 has the form of two hexagons, standing on the points and connected with a common vertical side surface, in the cross section, so that the cutting block 20 forms an upper V-shaped groove 21 and a lower inverted V-shaped groove 22 along its longitudinal extension, the bottom edges 21*a*, 22*a* of which are spaced from one another. The cutting block 20 has two upper edges 23 defining the groove 21, two surfaces 24 sloping outward from the edges 23 and side surfaces 25 extending vertically downward from the surfaces 24. The groove 22 is limited by edges 26 from which diagonal surfaces 27 extend outward at the top and meet the surfaces 25 with which they form a common edge. The cutting block 20 forms two front surfaces 28, 29 corresponding to the cross section, the grooves are formed by two diagonal surfaces 21*b*, 22*b* each at an angle to one another. The distance of the groove bottom 21*a*, 22*a* corresponds to the width of the surfaces 25, whereby the groove bottom closes vertically with the upper and lower edges limiting the surfaces 25. A vertical bore 30 is placed in the block 20 on the longitudinal axis, each bore tapering conically from the top and bottom to the vertical centre of the cutting block 20, so that two receiving cones 31 are formed for accommodating countersunk screws. The slope of the surfaces 27 or surfaces 24 corresponds to the slope of the surfaces 8, 9 of a first embodiment, so that the cutting block 20 can be inserted in a form-locking manner in a knife seat groove of a cutting shaft. The edges 23 have the same radial distance from the bottom of the groove of the cutting knife groove as the edge 3 of a first embodiment, so that the cutting tool of the first embodiment may be replaced by a cutting tool of the second embodiment without it being necessary to exchange the shaft, since the radial flight circle of the edges or points projecting beyond the shaft is the same.

To enable an optimum seat of the cutting block 20 in a knife groove, a rhombic insert 35 is provided, the length of which corresponds to that of the cutting block 20. The rhombic insert 35 has an upper edge 36, a lower edge 37 and two outer edges 30. The edges 36, 37, 38 limit four similar surfaces 39 and two rhombic front surfaces 40. A continuous bore of a continuous hole 41, which aligns with the hole 31 of a cutting block, is placed in the insert 35 from the edge 36 to the edge 37 on the longitudinal, axis. The surfaces 39 have the same orientation and size as the surfaces 21*b*, 22*b*, so that the insert can be fitted in a form-locking manner into the grooves 21, 22 of the cutting block 20. A screw bolt for fastening the cutting block 20 in a knife groove also passes through the bore 41 of the insert 35. The surfaces 21*b* and 24 as well as 22*b* and 27 formed a cutting edge each at the front, whereby the cutting block 20, since it is mirror-symmetric, can be turned about a horizontal axis after a cutting edge is worn.

Figure 7:
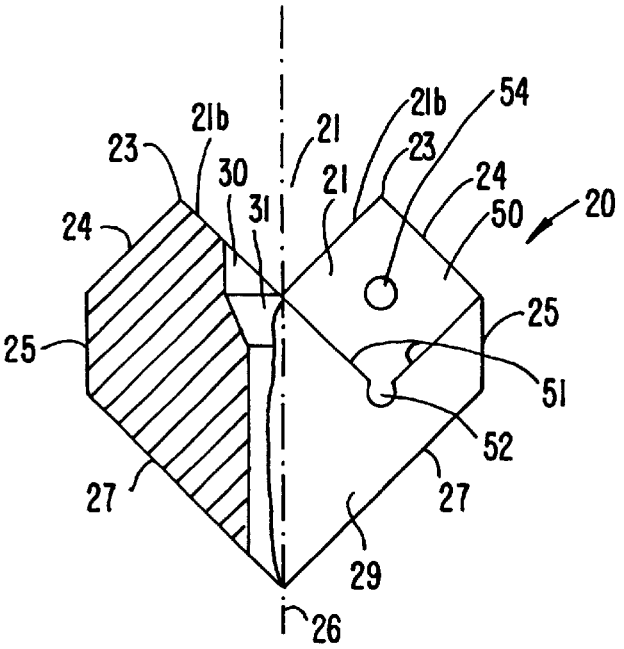
FIG. 7 is an enlarged cutting tool carrier according to the invention, in a partially cut top view.
Figure 8:
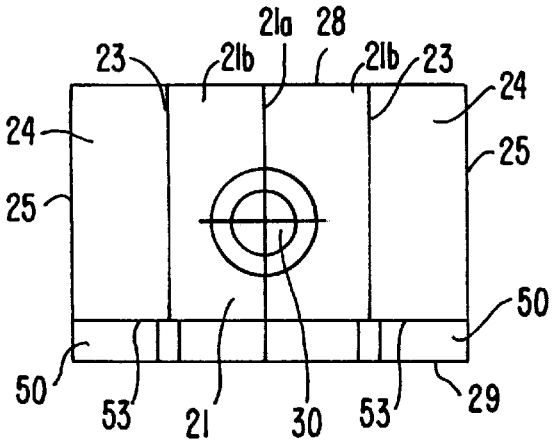
FIG. 8 is a cutting tool carrier according to FIG. 7, in a view from the top.
Figure 12:
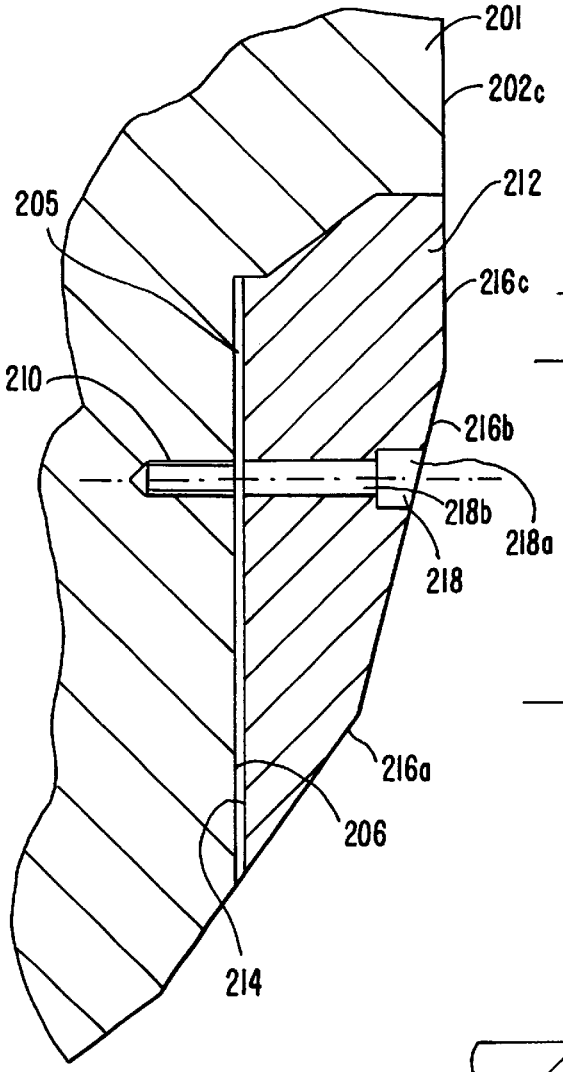
FIG. 12 is a cover element for an empty knife seat on a knife shaft in a longitudinal section.

In a further embodiment of the cutting block (FIGS. 7, 8), only an upper groove 22 is present. The lower diagonal surfaces 27 are continuously extended to the transverse axis at the cutting block and form a single lower edge 26 in the transverse axis of the cutting block. The surfaces 27 and the edge 26 correspond with the surfaces and the groove bottom of a knife seat groove of a cutting shaft. In the area of a front surface 29, two rhombic knife plate seats 50 are recessed in the front end 29. The rhombic knife seats 50 have two bearing surfaces 51 for the knife-plates arranged at an angle to one another, whereby a knife plate bearing surface 51 extends diagonally downward on the outside from edge 21*a* and the related second knife plate bearing surface 51 extends diagonally inward at the bottom, parallel to surface 27, from the edge formed by the surface 24 and 25. The knife bearing surfaces 51 thus form a flat recess 50 made in the front surface 29 with respect to the longitudinal extension of the block 20, whereby the lower point or recess is rounded and fluted in the common origin of the surface 51 for accommodating the lower point of a knife plate. The surfaces 21*b*, 24 and 51 defined, at the front end, a rhombic knife bearing surface 53 into whose symmetrical axis a horizontal threaded bore 54 is placed.

Figure 9:
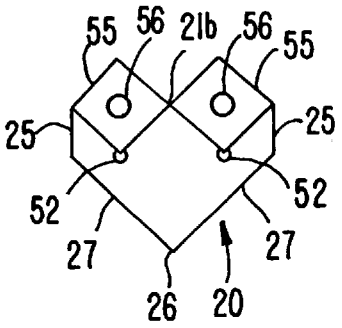
FIG. 9 is a cutting tool carrier according to FIG. 7 with two mounted knife plates having a straight cutting contour.
Figure 10:
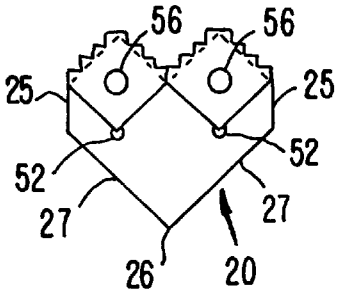
FIG. 10 is a cutting tool carrier according to FIG. 7 with two mounted knife plates having a staggered cutting contour.
Figure 11:
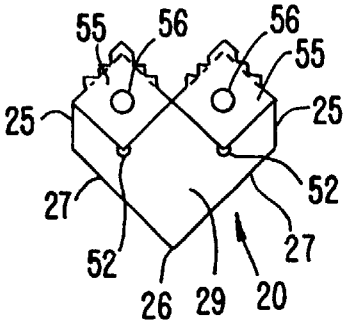
FIG. 11 is a cutting tool carrier according to FIG. 7 with a further embodiment of knife plates.

Rhombic cutting plates 55 (FIGS. 9 to 11) may be inserted into the knife seats 50, whereby the knife plates 55 have horizontal bores 56 in their symmetrical axis, through which a threaded bolt can be inserted and screwed into the threaded bore 54. The knife a plates 50 are, for example, rhombic knife plates which are dimensioned in such a way that they can be inserted into the press fit 50 so as to be aligned and that they close with the outer contour of the cutting block 20. Moreover, the knife plates 55 can be inserted (FIGS. 10, 11) which have a cutting contour projecting beyond the surfaces 21*b*, 24, for example, a staggered cutting contour. Contours of this type are used if finer granulated material is to be obtained.

The outwardly directed points of the rhombic cutting plates or edges 23 are spaced from a groove bottom of a knife seat groove at the same distance radially as an upper point 3 of a cutting block 1, so that the radially outermost point of all embodiments is situated on an outer radial knife flight circle. Thus, the cutting edge length in knives with two cutting points is just as large as the length of the cutting edges of a knife with a large cutting point, whereby the depth of engagement into the counter knife plates in a knife with two points is only half as much.

The use of the knives is described in the following.

Especially for cutting large-sized materials, cutting blocks 1 having a rhombic cross section are inserted into a groove of the knife (not shown), so that the edges 3 or the cutting edges point radially outward. The counter cutting edges of the cutting bar or the scraping bar have a corresponding cutting contour.

If smaller material is to be cut with a cutting shaft thus equipped or a cutting machine of this type or if finer granulated material is to be obtained, a cutting block 20 with opposite V-shaped grooves 21, 22 is screwed into the V-shaped knife seat groove instead of a cutting block 1, whereby the groove 22 pointing downward to the cutting shaft is closed with an insert 35. The surfaces 27 of the cutting block and 39 of the insert 35 provide a common V-shaped surface which is fitted into the V-shaped knife seat groove in a form-locking manner. A screw bolt is bolted into a bore in the knife seat groove through holes 30, 41. The cutting contour of the counter cutting bar or scraping bar is then adjusted to the new cutting contour having two small cutting points per cutting block, so that the cutting contours correspond and mesh. The engagement depth of the cutting contours of the cutting blocks 20 and the corresponding cutting bar is lower in a design of this type, in particular half as much as with an embodiment having cutting blocks 1. The granulated material is accordingly finer. If the cutting edges 23 are worn, the cutting block 20 can be removed from the knife seat after the screw has been removed, whereby the invert 35 remains in the knife seat. The cutting block 20 is turned horizontally by 180° and placed with the groove 21 on the insert, so that the edges 26 are the outermost projecting cutting edges. If these are worn, the block can then be turned vertically by 180°.

Figure 13:
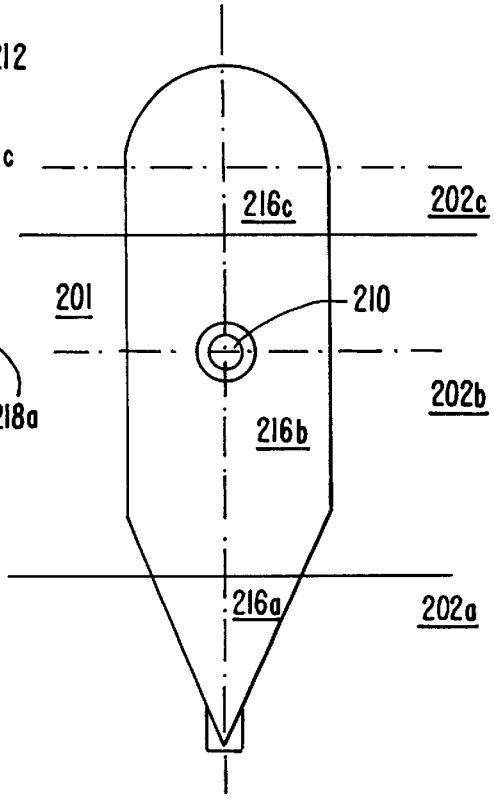
FIG. 13 is a cover element according to FIG. 12 in a top view.
Figure 14:
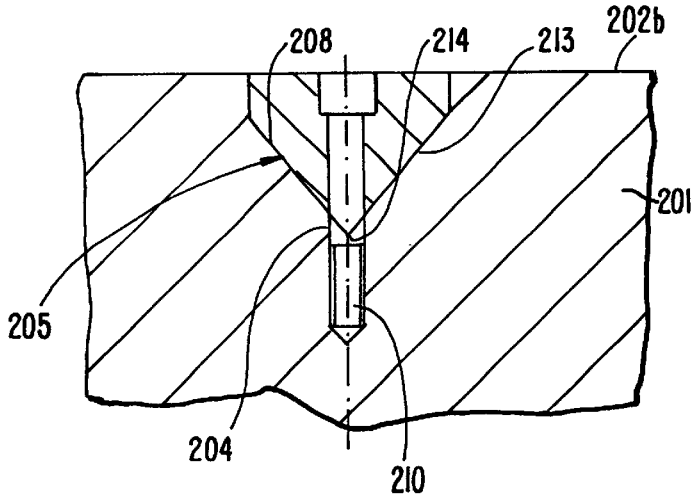
FIG. 14 is a cover element according to FIG. 12 in a knife a seat in a cross-section.
Figure 15:
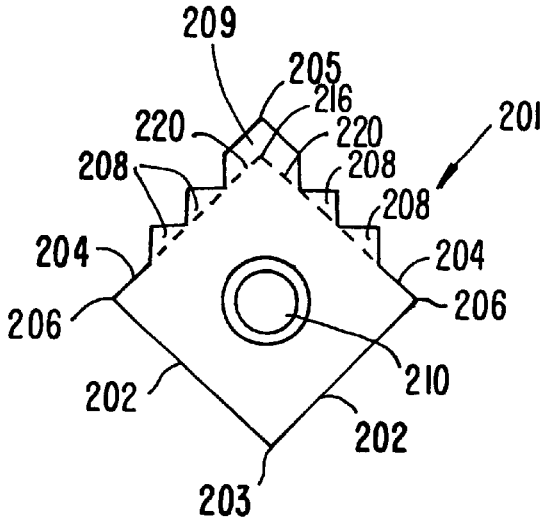
FIG. 15 is a serrated knife according to the invention in a top view.
Figure 16:
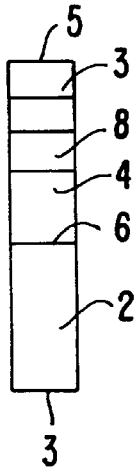
FIG. 16 is a serrated knife according to FIG. 15 in a side view.
Figure 17:
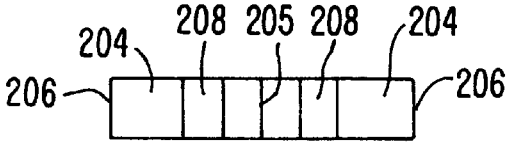
FIG. 17 is a serrated knife according to FIG. 15 in a view from the top.
Figure 18:
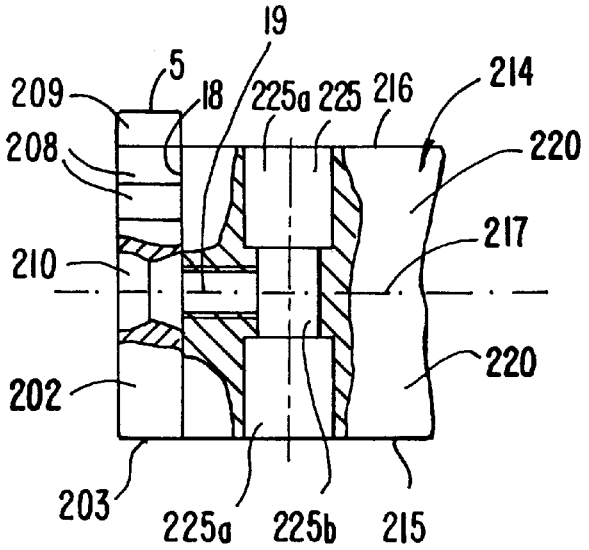
FIG. 18 is a serrated knife according to FIG. 15 in a front arrangement on a conventional cutting tool.
Figure 19:
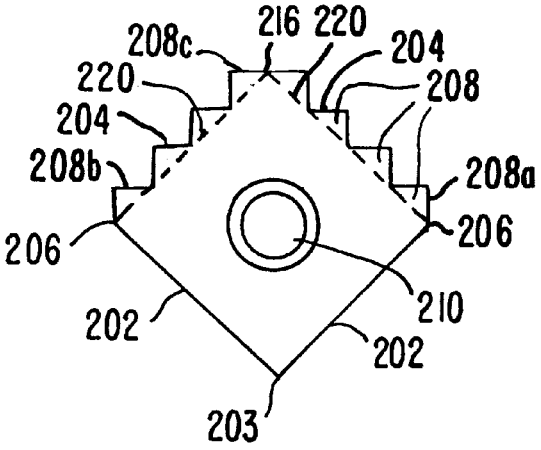
FIG. 19 is a further embodiment of a serrated knife according to the invention in a top view.
Figure 20:
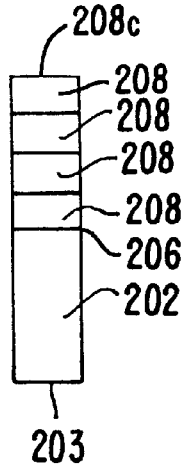
FIG. 20 is a serrated knife according to FIG. 19 in a side view.
Figure 21:
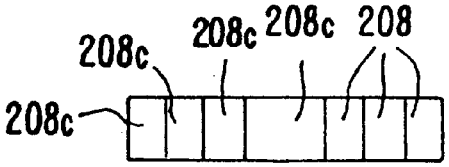
FIG. 21 is a serrated knife according to FIG. 19 in a view from the top.

When using cutting blocks 20 with only one groove 21 and rhombic press fits 50 for the cutting, knife plates, the cutting block is fitted in a form-locking manner into a V-shaped knife seat groove with the surfaces 27 and edge 26 and bolted with the cutting shaft with a screw bolt which is inserted through the bore 30. Rhombic knife plates 55 (FIG. 9) may be inserted into the knife plate press fits 50. In this embodiment, the cutting contour of the counter cutting bar corresponds to the second embodiment of a cutting block. If even finer granulated material is to be obtained, cutting knife plates 53 having a cutting contour (FIGS. 13, 14) which may, e.g. be staggered and projecting beyond the surfaces 21*b*, 24, may be used, whereby the cutting contour of the counter cutting bars must be adjusted to this finer cutting contour i.e. the knife plates of the counter cutting bars must be replaced by the knife plates corresponding to the knife plates 50.

The advantage of the cutting tools of the invention is that a knife shaft or cutting shaft can be provided with another cutting contour, adjusted to the material to be cut, in a very short time, so that many materials that are completely different may be cut with a single cutting machine. For this purpose,both the cutting contour can be altered and the type of knife block or the cutting knife plates used may also be changed, for example, cutting tools can be used which are made from different materials, adjusted to the material to be cut. Of course, conventional cutting tools or cutting tools of conventional size can be exchanged for cutting tools configured according to the invention and having a corresponding smaller cutting contour, so that the cutting contour is refined. Of course, the cutting contour of the counter cutting element must correspond to the respective cutting contour, in particular, ensure a meshed engagement.

Figure 22:
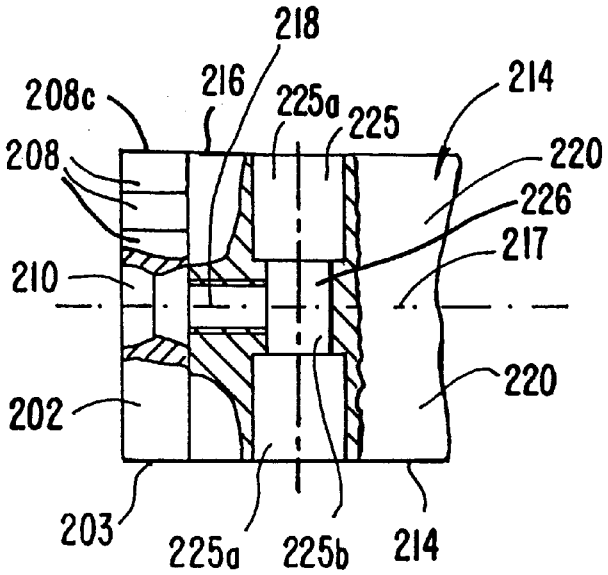
FIG. 22 is a serrated knife according to FIG. 19 in a front-end arrangement on a conventional cutting tool.
Figure 23:
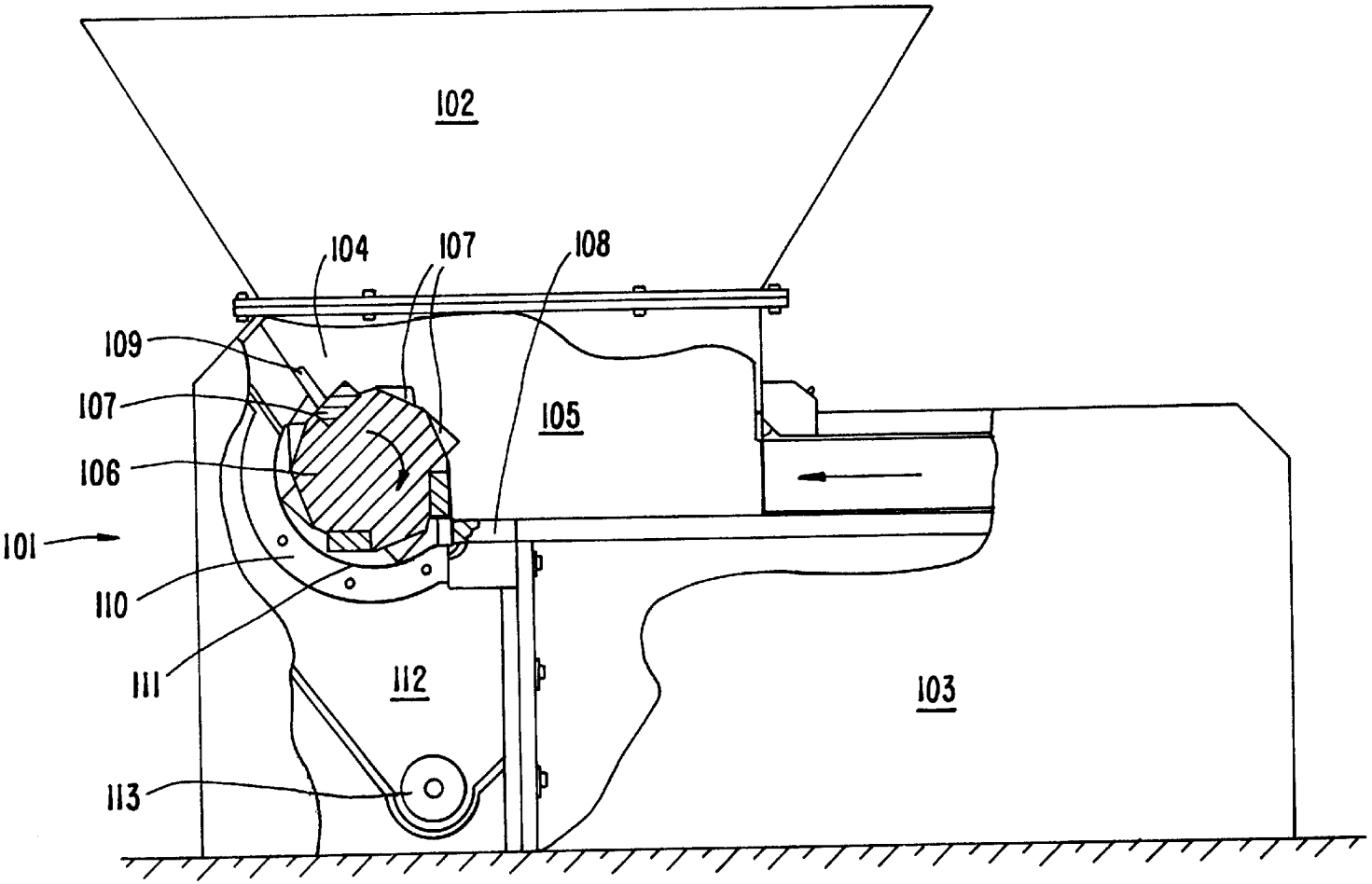
FIG. 23 is a cutting machine with cutting shaft and cutting tools arranged thereon.
Figure 24:
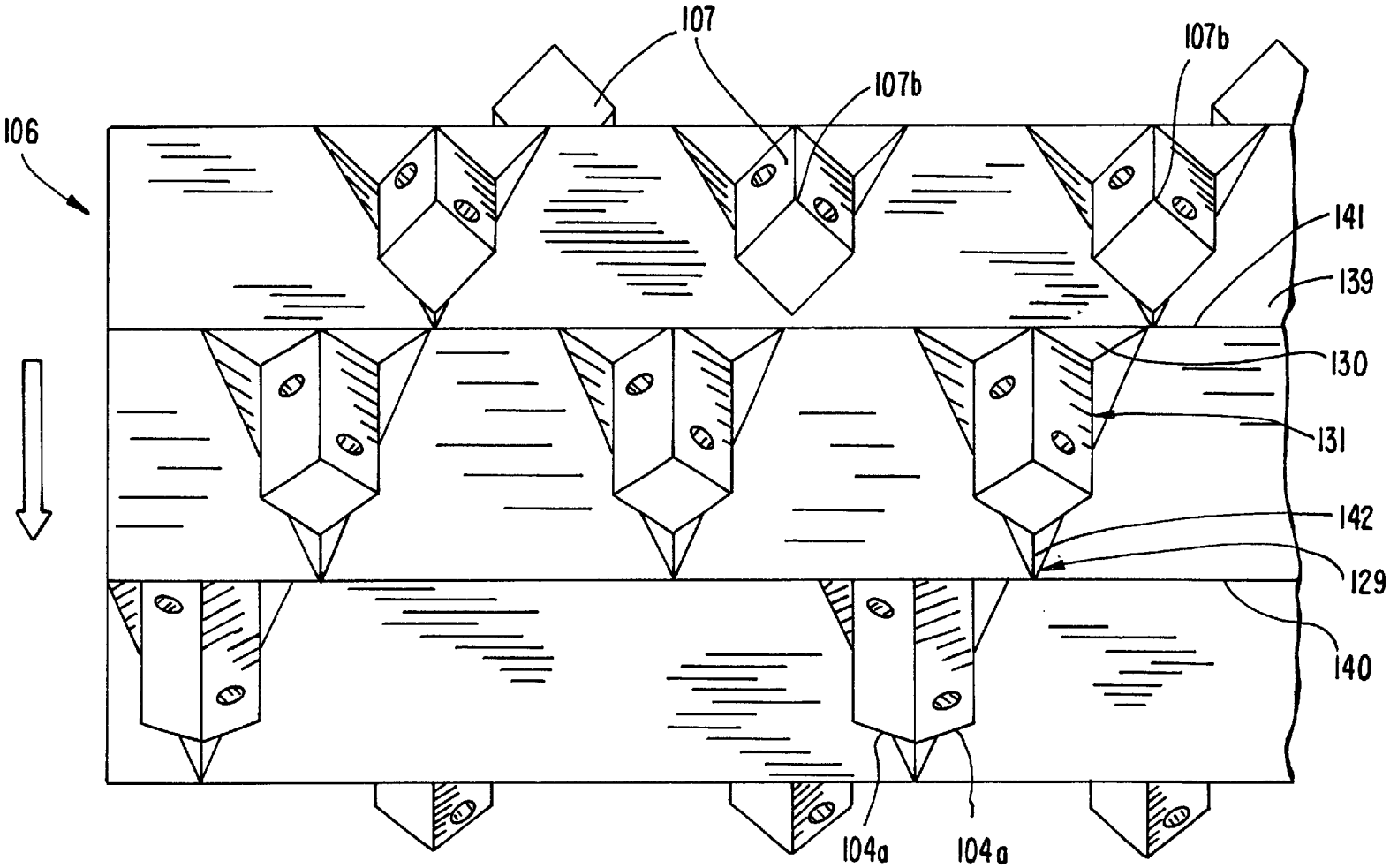
FIG. 24 is a cutting shaft according to FIG. 23 in a top view.

A cover element 212 (FIGS. 22 to 14) according to the invention is, for example, solid, e.g. made of metal or ceramics and has walls 213 corresponding to the diagonal walls 8 of the knife seat and meeting at a common edge 214. When the cover element 212 is placed in the groove 205, the edge 214 is situated between the short walls 207 and is preferably slightly spaced from the bottom of the groove 206. The remaining surfaces of the cover element 212 correspond to the groove, so that the cover element 212 is made so as to be in the shape of a semicircular cone in the area of a surface 202*c* of the shaft 201 or the groove end 205*a* and tapers from the semicircular conically shaped and 213 along the groove 205, whereby the cover element 212 has surfaces 216*a*, 216*b* and 216*c* pointing outward and oriented at an angle to one another, which each align or close with the surfaces 202*a*, 202*b* and 202*c* of the polygonal cutting shaft 201.

Aligned with a bore 210 in the groove bottom 206, the cover element 212 has a bore 218 placed in the cover element from the surface 216*b* at right angles to the edge 214 and which becomes narrower from a further area 218*a* with a step 219 to a narrower area 218*b*. A threaded bolt in inserted through the bore 218 or hole 18 are screwed into the threaded bore 210 of the shaft in order to rigidly fix the cover element 212 in the groove. The covet element 212 does not have to be a solid, it can also be made as a hollow profile.

The angle and size of the surfaces 216 depend on the number of edges and on the diameter of the polygonal shaft. With a smaller diameter the angle of the surfaces to one another becomes greater and reversed.

The use of the cover element described in the following.

In order to apply an increased force on the individual cutting tools at the same driving power and the same speed of the cutting shaft, in particular with larger cutting tools and greater engagement depth, it may be necessary to reduce the number of knives. Usually several cutting tools, e.g. up to eight, are found on a cutting tool flight circle with cutting tools generally spirally wound and distributed over the periphery; so that during a rotation of the shaft a cut is made eight times in this flight circle. The number of knives can, for example, be halved on a knife flight circle, so that only four cuts are made during a rotation. The empty four knife seats or grooves are covered with the cover element of the invention, whereby it is advantageous that the cover elements prevent material from accumulating in the groove or prevent difficult-to-cut material, such as e.g. carpets, from catching on empty grooves 5 and winding about the shaft without being cut. Moreover, it is advantageous that the cover element may be manufactured in an especially simple and easy manner, for example, by metal casting.

By providing cover elements, it is thus possible to quickly refit a conventional cutting shaft to various types of materials when using cutting tools of various sizes or different cutting geometries. As a result of the form of the cover element corresponding to the groove and the fastening of the caviar element with a screw connection equivalent to the knives, the refitting can be easily and especially quickly accomplished.

A cutting tool (201) according to the invention (FIGS. 15 to 18) is, in a top view, an essentially rhombic plate having two lower straight edges 202, which extent divergently from a common edge 203. From the lower edges 202, upper edges 204 extent toward one another and meet at a common upper edge or point 205. The edges 202 and 204 meet at common side points or edges 206 of the rhombic cutting tool 201.

The upper edges or surfaces 204 of the plate-shaped cutting tool 201 are stepped or a staggered with teeth 208 projecting outward. The edges or surfaces 204 first extend at an angle of about 90° from the points 206 to the edges 202 and then each form two teeth 208, the one tooth side being directed vertically and the other tooth side horizontally. A single tooth 208 in the shape of a peaked roof is formed in the area of the upper point 205 of the rhombus.

A bore 210 is placed at the centre in the cutting tool 201, in the intersection of the lines between the side points 206 and the lower points 203 and the upper points 205, said bore tapering conically to the thickness centre of the plate and then expanding conically again from the centre of thickness. The conical bore sections 210*a*, 210*b* serve to accommodate a screw bolt having a countersunk head.

The rhombic plate or cutting tool 201 is screwed at the front and an a tool carrier 214 having a rhombic cross section. The rhombic cutting tool carrier 214 has a lower longitudinal edge 215 and an upper longitudinal edge 216 as well as two side longitudinal edges 217. In a front end 218 of the knife carrier 214, an axial bore 219 is placed in the centre which aligns with the bore 210 when the plate 201 is placed on the cutting knife carrier. The lower edge 215, the outer edges 217 and the side surfaces 220 of the knife carrier 214 between the edges 215 and 217 close, with the lower edge 23, the outer points or edges 206 when the lower edges 203 and the edges 202 of the serrated knife 201 situated between the edges 203, 206. In the area of the upper surfaces 220 of the knife carrier 214, the teeth 208 of the cutting tool or serrated knife 201 protrude beyond the surfaces 220 and edges 216.

In a further embodiment of the cutting tool (FIGS. 19 to 22), a first step or a first tooth 208 with a vertical side 208*a* adjoins the side edges or points 206 of the cutting tool 201. A horizontal side 208*b* extends from the side 108*a* to inside the rhombus until it meets an imaginary line which extends from the outer points 206 at a 90° angle to the edges 202. Three further teeth adjoin the toothed edges along this imaginary line continuing upward, whereby the two uppermost tooth of the two upper edges 204 meet and form a plate or flat edges 208*c* in the uppermost area. When screwed onto a knife carrier 214, the surface or edge 208*c* closes with the uppermost edge 216 of the knife carrier having a rhombic cross section, so that the teeth only laterally project beyond the surfaces 220.

The cutting tool carriers 214 have a vertical bore 225 from edge 216 to edge 214 which extends from the edge 216 at right angles to a longitudinal axis 224 of the carrier. The bore extends with a further bore area 225*a* from edge 216 into the carrier 214 and becomes narrower above the transverse axis with a step 226 to a narrower bore area 225, which expands again to further bore area 225*a* in the further course to the edge, whereby this bore 225 is mirror symmetric with respect to the narrowing and expansion to the transverse axis. The bore 225 serves to accommodate a screw bolt (not shown) with which a knife carrier 214 is arranged in a cutting tool recess or a cutting tool seat.

The cutting tools 201 can be used as rotating knives, so that, once the edges 204 in the area of a front end are worn, the knife in unscrewed from the knife holder 217, turn and can be fastened to the knife carrier again.

The advantage of the cutting tool of the invention is that defined, in particular, small granulated material can be obtained with the cutting tool in the form of a serrated knife at the same driving power and same speed of a shaft. In addition, the knives are simple to manufacture and can also be screwed onto existing knife carriers.

The knives do not have to be used as rhombic plates. It is also possible to use one-piece longitudinal knife blocks having a rhombic cross section with toothed, upward pointing surfaces.

The cutting contours of the counter cutting or scraping bars must, of course, have a counter cutting edge corresponding to the cutting contour of the cutting tools.

What is claimed is:

1. In a cutting shaft (106) for cutting machine (101) for shredding particles of a first size, the cutting shaft (106) having knife seat grooves (129) spirally wound and distributed on the periphery of the cutting shaft (106), whereby cutting tools (1) with at least one cutting tooth having a cutting edge are placed in knife seat grooves (129) having a certain maximum of protrusion beyond the periphery of the cutting shaft (106), the cutting tools (1) having a first engagement depth with corresponding counter cutting means (108) of the cutting machine, the replacement improvement to the cutting tools with at least one cutting tooth for shredding particles of a second and smaller size comprising in combination:

at least one cutting tool (20) having cutting teeth in excess of the cutting teeth of the cutting tools (1) provided for mounting in the knife seat grooves (129), the cutting tools, (20) having at least the same entire cutting edge length and the same maximum protrusion beyond the periphery of the cutting shaft (106) as the cutting tool having the at least one cutting tooth (1), the distal end of the cutting teeth in excess of the cutting teeth of the cutting tools (1) extending beyond the periphery of the cutting shaft (106), the cutting tools (20) having second and lower engagement depth with the counter cutting means (108) when compared with the cutting tools (1).

2. In a cutting shaft for cutting machines according to claim 1 wherein the cutting edge is shaped like a peaked roof.

3. In a cutting shaft for cutting machines according to claim 1 wherein the cutting edge has two adjacent, pointed cutting edges.

4. In a cutting shaft for cutting machines according to claim 1 wherein an enlarged cutting tool (1) having cutting teeth each with a pointed cutting edge comprise blocks, rhombic in cross section to form a rhombic cutting block, with a lower edge (2) and an upper edge (3) opposite thereto, which open to a vertical plane (4), whereby the block (2) has opposite, horizontal edges (5, 6) which open to a horizontal plane (7) directed at right angles to the plane (4) and cutting it in the center.

5. In a cutting shaft for cutting machines according to claim 4 wherein the edges (2, 5) define a lower diagonal surface (8) and the edges (2, 6) a lower diagonal surface (9) of the rhombic cutting block (1).

6. In a cutting shaft for cutting machines according to claim 5 wherein the rhombic cutting block (1) is situated in a knife seat groove of the cutting shaft, essentially forming a V-shaped groove, with the surfaces (8, 9).

7. In a cutting shaft for cutting machines according to claim 4 wherein the edges (5, 3) define an upper diagonal surface (10) and the edges (6, 3) an upper diagonal surface (11).

8. In a cutting shaft for cutting machines according to claim 4 wherein the rhombic cutting block (1) having four similar surfaces (8, 9, 10, 11) forms two rhombic front surfaces (12,13).

9. In a cutting shaft for cutting machines according to claim 4 wherein the rhombic cutting block (1) adjoins, with a front end (13) a flat surface of a knife backing of the cutting shaft, whereby a common edge (10*a*) of a surface (10) and a front end (12), as well as the common edge (11*a*) of a surface (11) and a front ead (12), form the pointed cutting edge projecting beyond the periphery of the cutting shaft.

10. In a cutting shaft for cutting machines according to claim 1 wherein the cutting tool (20) has the form of two hexagons connected to one another, standing on the point in the area of a common vertical side surface, so that the cutting block forms an upper, V-shaped groove (21) and a lower inverted U-shaped groove (22) along its longitudinal extension.

11. In a cutting shaft for cutting machines according to claim 10 wherein the cutting block (20) has two upper longitudinal edges (23) defining the groove (21), two surfaces (24) sloping outward from the edges (23) and side surfaces (25) extending vertically downward from the surface (24).

12. In a cutting shaft for cutting machines according to claim 10 wherein the cutting block (20) has single upper groove (21), whereby the lower, outer, diagonal surfaces (27) are extended continuously to the transverse axis of the cutting block (20) and form a single lower longitudinal edge (26) in the transverse axis of the cutting block (20), whereby the surfaces (27) and the edges (26) correspond with the surfaces and the groove bottom of a knife seat groove of a cutting shaft.

13. In a cutting shaft for cutting machines according to claim 12 wherein, in the area of a front end (29), two flat, rhombic knife plate seats (50) are recessed in the front end (29), whereby the rhombic knife seats (50) have two narrow knife plate bearing surfaces (51) directed at right angles to the front end (29) and angled vis-à-vis one another, whereby one knife plate bearing surface (51) on the edge (21*a*) extends diagonally downward and the related second knife plate bearing surface (51), at an angle thereto, extends diagonally inward at the bottom from the edge formed by the surface (24, 25), parallel to the surface.

14. In a cutting shaft for cutting machines according to claim 1 wherein a number of knife seat grooves are arranged on a common, radial shaft plane, so that several cutting tools are arranged on a common radial cutting tool flight circle, whereby, adjusted to a desired cutting operation, the knife seat grooves (4) of a common radial plane of the shaft are uniformly furnished with cutting tools (1, 20) and predetermined knife seat grooves are not equipped with a cutting tool (1, 20) and are covered with a securable cover element (212).

* * * * *